United States Patent [19]

Titemore et al.

[11] Patent Number: 4,662,263

[45] Date of Patent: May 5, 1987

[54] AMMUNITION FEED SYSTEM INTERFACE

[75] Inventors: Robert G. Titemore, Burlington; Robert A. Patnode, Colchester, both of Vt.

[73] Assignee: General Electric Company, Burlington, Vt.

[21] Appl. No.: 678,512

[22] Filed: Dec. 5, 1984

[51] Int. Cl.[4] ..... F41D 9/02

[52] U.S. Cl. ..... 89/33.14

[58] Field of Search ..... 89/33.1, 33.02, 33.01, 89/33.14, 33.16; 193/25 AC

[56] References Cited

U.S. PATENT DOCUMENTS

| | | | |
|---|---|---|---|
| 2,303,976 | 12/1942 | Bowcutt | 89/33.01 |
| 2,477,264 | 7/1949 | Pearson et al. | 89/33 |
| 2,740,180 | 4/1956 | Nobles | 89/33.14 |
| 2,935,914 | 5/1960 | Darsie | 89/33 |
| 2,993,415 | 7/1961 | Panicci | 89/33 |
| 3,250,360 | 5/1966 | Correll | 89/33 |
| 3,307,452 | 3/1967 | Meunier | 89/33 |
| 3,429,221 | 2/1969 | Kirkpatrick | 89/33 |
| 3,696,704 | 10/1972 | Backus et al. | 89/33 |
| 4,044,649 | 8/1977 | Wilder | 89/33 |
| 4,314,501 | 2/1982 | Kirkpatrick et al. | 89/12 |
| 4,416,184 | 11/1983 | Jenny | 193/25 AC X |
| 4,434,699 | 3/1984 | Tassie | 89/12 |
| 4,437,384 | 3/1984 | Tassie | 89/37 |

*Primary Examiner*—Harold D. Whitehead

*Attorney, Agent, or Firm*—Bailin L. Kuch

[57] ABSTRACT

An interface structure between a recoiling gun and a stationary ammunition supply having a plurality of elongated, individually rigid, guide elements, for providing continuous guide surfaces for the individual elements which are connected to form the endless conveyor and the individual rounds of ammunition respectively carried thereby, and having three degrees of freedom of movement.

6 Claims, 4 Drawing Figures

AMMUNITION FEED SYSTEM INTERFACE

BACKGROUND OF THE INVENTION

1. Field of the Invention

This invention relates to the interface between an endless conveyor in a supply chute of a substantially stationary ammunition supply system and a recoiling, high rate of fire gun.

2. Prior Art

The conventional interface between an endless conveyor in a supply chute of a substantially stationary ammunition supply system and a recoiling, high rate of fire gun is provided by at least a length of flexible chuting such as is shown, for example, in U.S. Pat. No. 2,993,415 issued July 25, 1961 to E. W. Panicci et al. U.S. Pat. No. 2,993,415 shows the use of an endless conveyor within the supply chute and is an improvement over U.S. Pat. No. 2,935,914 issued May 10, 1960 to B. Darsie et al which shows a rigid chute through which the successive mutually abuting rounds are pushed. Other systems utilize linked ammunition, rather than an endless conveyor, and are shown, for example, by U.S. Pat. No. 2,477,264 issued July 26, 1949 to C. B. Pearson et al, U.S. Pat. No. 3,307,452 issued Mar. 7, 1967 to R. Meunier and U.S. Pat. No. 3,250,360, issued May 10, 1966 to C. V. Correll. However, high rate of fire systems utilize an endless conveyor as shown, for example, by U.S. Pat. No. 3,429,221, issued Feb. 25, 1969 to R. G. Kirkpatrick, and U.S. Pat. No. 4,044,649, issued Aug. 30, 1977 to F. A. Wilder.

The flexible chuting, comprised of partially overlapping layers of bent-up sheet metal which serve as a guide for the endless conveyor and its ammunition, conventionally has a short service life.

SUMMARY OF THE INVENTION

An object of this invention is to provide an interface structured to accommodate gun movement relative to a stationary supply chute, all having an endless conveyor for ammunition within, which substantially isolates the gun movement from the supply chute.

A feature of this invention is an interface structure between a recoiling gun and a stationary ammunition supply having a plurality of elongated, individually rigid, guide elements, for providing continuous guide surfaces for the individual elements which are connected to form the endless conveyor and the individual rounds of ammunition respectively carried thereby, and having three degrees of freedom of movement.

BRIEF DESCRIPTION OF THE DRAWING

These and other objects, features and advantages of this invention will be apparent from the following specification thereof, taken in conjunction with the accompanying drawing, in which.

DESCRIPTION OF THE INVENTION

Figure 1:
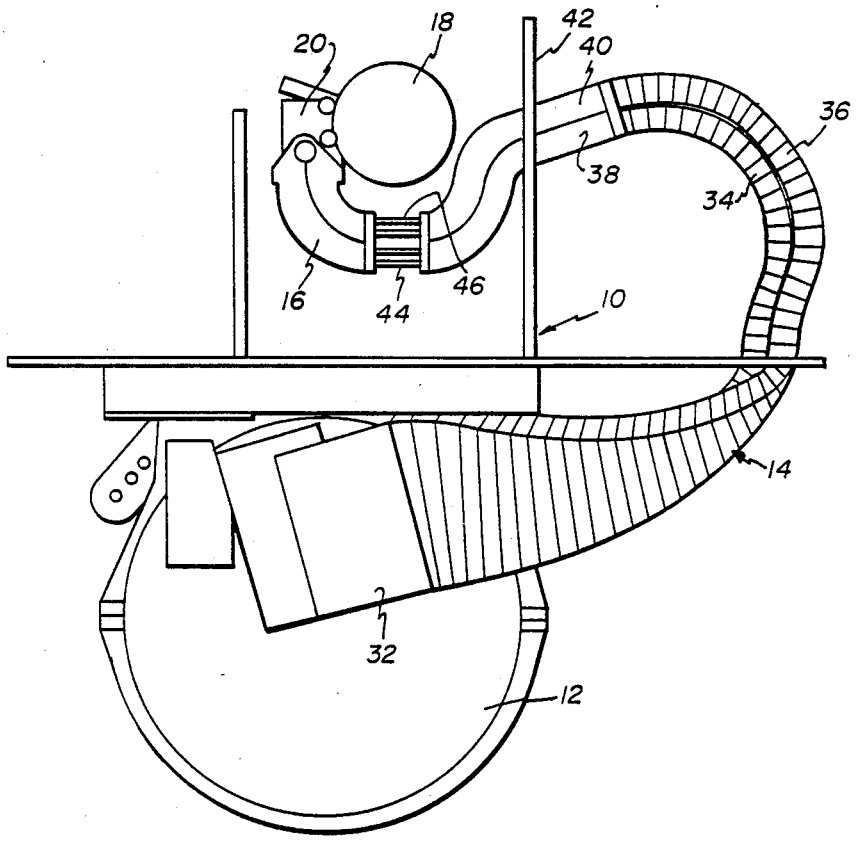
FIG. 1 is an idealized rear view of a gun and ammunition handling system in a turret arrangement and having an embodiment of this invention.
Figure 2:
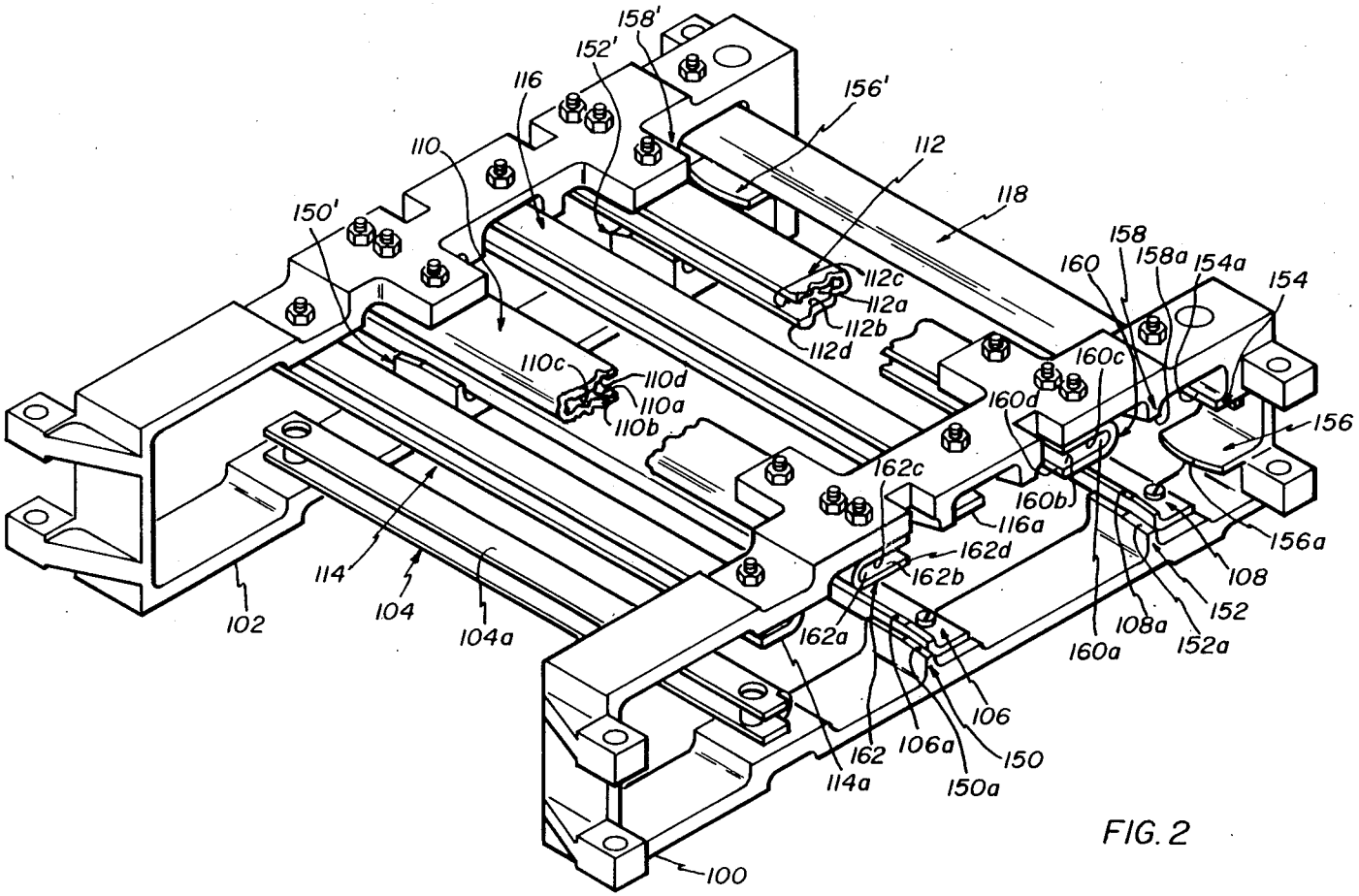
FIG. 2 is a perspective view of the embodiment of FIG. 1.
Figure 3:
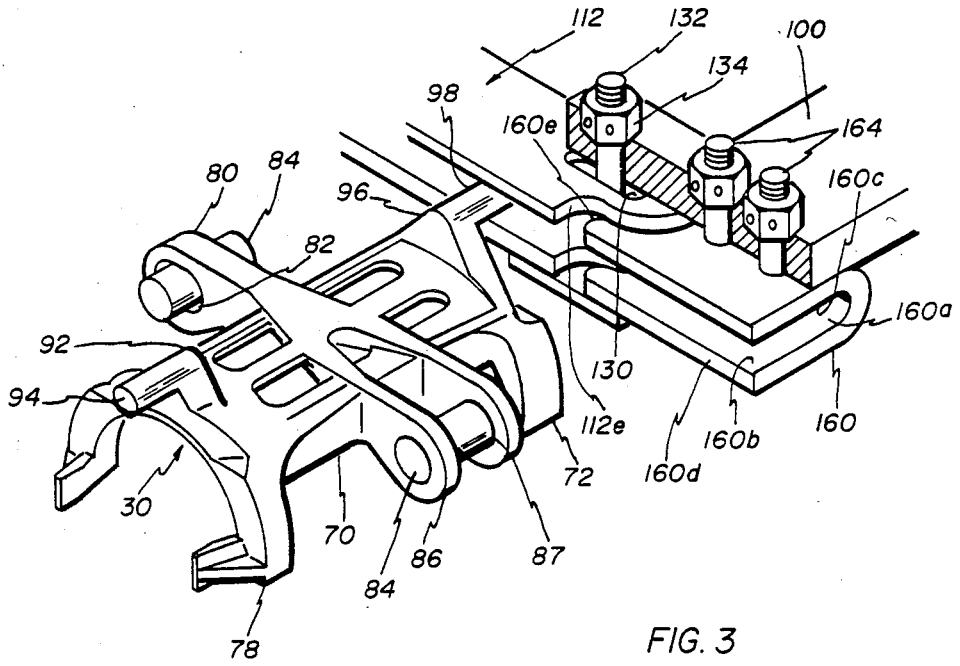
FIG. 3 is a perspective view of a detail of the embodiment of FIG. 1.
Figure 4:
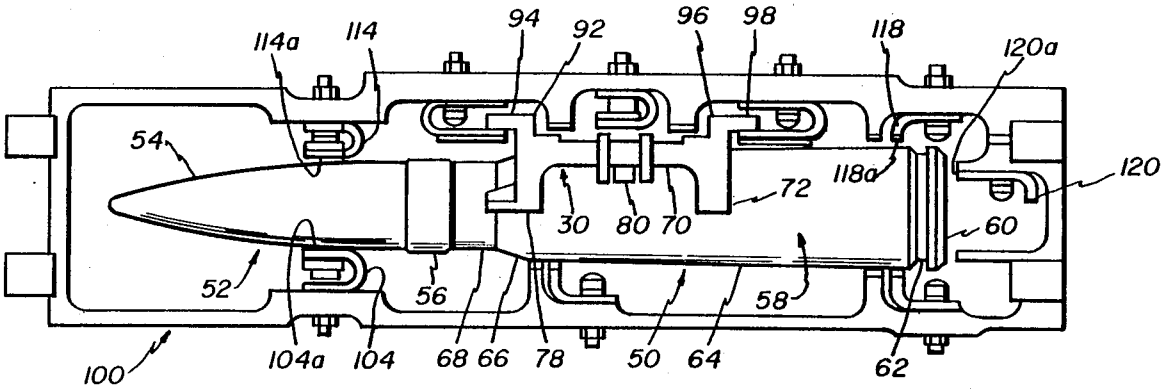
FIG. 4 is an end view of the embodiment of FIG. 1.

The turret arrangement 10 shown in FIG. 1 may be broadly of the type shown in U.S. Pat. No. 4,437,384, issued Mar. 20, 1984, to D. P. Tassie, but having an ammunition handling system including a drum storage 12 and a flexible endless conveyor system 14 of the types shown in U.S. Pat. No. 3,696,704, issued Oct. 10, 1972 to L. F. Backus et al. The turnaround and handoff-to-the-gun feeder mechanism 16 may be of the type shown in U.S. Pat. No. 3,429,221 issued Feb. 25, 1969 to R. G. Kirkpatrick and U.S. Pat. No. 4,044,649, issued Aug. 30, 1977, to F. A. Wilder. The gun 18 may be of the type shown in U.S. Pat. No. 4,314,501, issued Feb. 9, 1982 to R. G. Kirkpatrick et al and the feeder mechanism 20 may be a single feed rather than the dual feed of the type shown in U.S. Pat. No. 4,434,699, issued Mar. 6, 1984 to D. P. Tassie. The endless conveyor system 14 includes a plurality of conveyor elements 30 (shown in FIGS. 3 and 4) interconnected in an endless train as shown in U.S. Pat. No. 4,044,649, supra. The endless train passes through an exit unit 32 having a rigid housing at the drum 12, two side-by-side lengths of flexible chuting 34 and 36, two side-by-side lengths of rigid chuting 38 and 40 mounted to the turret elevation structure 42, two side-by-side mechanisms 44 and 46 each embodying this invention and shown in FIG. 2, and the turnaround 16 having a rigid housing.

Each conveyor element 30 is adapted to convey a round 50 of ammunition having a projectile 52 with a nose 54, a base, and a band 56, and a case 58 with an extractor disk 60, an extractor groove 62, a body 64, a conical shoulder 66, and a neck 68 receiving the base of the projectile.

Each conveyor element 30 has a body 70, an aft plate 72 integral with the body and having a concave cylindrical surface adapted to receive the case body, a forward plate 78 integral with the body and having a concave conical surface adapted to receive the case shoulder 66, a single forwardly projecting arm 80 integral with the body and having a transverse hole 82 to receive a pivot pin 84, a bifurcated rearwardly projecting arm 86 integral with the body and having a transverse hole 87 to receive the pivot pin, a forward leg 92 integral with and depending from said plate and having a transversely extending foot 94, and an aft leg 96 integral with and depending from said plate and having a transversely extending foot 98.

A typical gun 18 (and its feeder 20 and turnaround 16), here taken as a four barrelled, 30 mm gatling type gun, has significant recoil fore and aft movement from its static, non-firing disposition at which it may be nominally aligned with the interface of the fixed feed system 38, 40. The gun also undergoes some oscillatory motion in the plane which is transverse to its recoil motion. Ideally, the gun when firing normally should be at its best alignment with the fixed feed interface. For the exemplary gun, there will be the following fore and aft displacements:

| | |
|---|---|
| Peak Counter Recoil | +0.30 inches |
| Static Gun | 0.00 |
| Normal Firing Displacement | −0.38 |
| Normal Maximum Recoil | −0.75 |
| Maximum Recoil (Misfire) | −1.00 |
| Dither About The Normal Firing Displacement | ±0.38 |

The interface structure 44 (and 46 respectively) serves to isolate the movement of the gun, feeder and turnaround from the stationary interface of the remaining feed chute system, while providing smooth, uninterrupted guide surfaces for the endless train of conveyor elements 30 and their respective rounds 50 of ammunition.

Assuming an ideal situation of a constant lateral spacing, for example, nine inches between the gun interface and the feed interface, then the fore and aft changes of displacement for the above described exemplary gun are:

| From Static Point | From Normal Firing Point | Length of Guide From Normal Firing Point | Change In Length | Angular Deflection |
|---|---|---|---|---|
| +0.30 in. | +0.68 in. | 9.026 in. | .026 in. | 4.321° |
| 0.00 | +0.38 | 9.028 | .008 | 2.418° |
| −0.38 | 0.00 | 9.000 | 0.000 | 0.000° |
| −0.75 | −0.38 | 9.008 | .008 | 2.418° |
| −1.00 | −0.62 | 9.021 | .021 | 3.941° |

The lateral spacing does not remain constant due to the inherent lack of rigidity of the total system, and it has been estimated at ±0.10 inches of lateral motion occurs during firing. Therefore, the interface structure must accommodate this additional distortion, and an accommodation of ±8° and +0.300 in. and −0.20 in. suffices.

The interface structure 44 (and 46 respectively) includes a feed side bracket 100 and a gun side bracket 102. The structure 44, as shown, has the conveyor elements mounted above the rounds of ammunition (i.e., "element above"), while the structure 46 has the elements mounted below the rounds of ammunition (i.e., "element below").

The brackets 100 and 102 are interconnected by: A U-shaped beam 104 providing (when element above) a broad flat surface 104*a* for supporting the projectile 52. A L-shaped beam 106 providing (when element above) a narrow flat surface 106*a* for supporting the narrower full diameter of the case body 64. A L-shaped beam 108 providing (when element above) a narrow flat surface 108*a* for supporting the wider full diameter of the case body 64. A U-shaped beam 110 providing a groove 110*a* for receiving the foot 94 of the element 30, an inner flat surface 110*b* for supporting (when element above) the foot 94 and an inner flat surface 110*c* for supporting (when element below) the foot 94, and a narrow flat surface 110*d* for limiting transverse travel of the leg 92. A U-shaped beam 112 providing a groove 112*a* for receiving the foot 98 of the element 30, an inner flat surface 112*b* for supporting (when element above) the foot 98 and an inner flat surface 112*c* for supporting (when element below) the foot 98, and a narrow flat surface 112*d* for limiting transverse travel of the leg 96. A U-shaped beam 114 providing (when element below) a broad flat surface 114*a* for supporting the projectile 52. A U-shaped beam 116 providing (when element above or below) a wide flat surface 116*a* for limiting transverse travel of the body of the element. A L-shaped beam 118 providing (when element below) a narrow flat surface 118*a* for supporting the wider full diameter of the case body. An L-shaped beam 120 providing (when element above or below) a narrow flat surface 120*a* for limiting transverse travel the base surface of the case disk 60. It should be noted that the concave conical surface of the element 30 limits transverse travel of the shoulder 66 of the case, and thus the case is transversely constrained between the element conical surface and the surface 120*a*, and between the surfaces 106*a* and 108*a* and the surface 118*a* and the element 30.

Each of these beams is pivotally mounted at its respective ends to a respective bracket by means of a double slot (e.g. 130), in the case of an U-shaped beam (e.g. 112), or a single slot in the case of a L-shaped beam (e.g. 118), which slot passes a bolt 132 held by a lock nut 134. The lock nut is less than fully clamped down to permit the beam to twist slightly with respect to the bolt and the bracket, besides sliding to and from with respect to the bolt and the bracket to enlarge or contract its effective length between the two brackets.

The adjacent fixed chutes 38 and 40 and the turnaround 16 have guide surfaces for the elements 30 and the cases 64 as shown in U.S. Pats. Nos. 3,429,221 and 4,044,649, supra. To preclude the transient development of lacunae in the continuity of the support sufaces of the fixed chutes and the turnaround and the support surfaces of the interface structure 44 and 46, the end brackets 100 and 102 are respectively provided with fixed support surfaces adjacent to and overlapping the end of the support surface of each beam, (except projectile guiding beams 104 and 114).

On the bracket 100, there are: A boss 150 having a narrow flat surface 105*a* spaced adjacent to and coplanar with the end margin of the surface 106*a*. A boss 152 having a narrow flat surface 152*a* spaced adjacent to and coplanar with the end margin of the surface 108*a*. A box 154 having a narrow flat surface 154*a* spaced adjacent to and coplanar with the end margin of the surface 120*a* plus a boss 156 having a narrow flat surface 156*a* spaced less than the diameter of the base of the disk 60 and coplanar with the end margin of the surface 120*a*. A boss 158 having a narrow flat surface 158*a* space adjacent to and coplanar with the end margin of the surface 118*a*. a U-shaped beam 160 providing a groove 160*a* for receiving the foot 98 of the element 30, an inner flat surface 160*b* for supporting (when element above) the foot 98 and an inner flat surface 160*c* for supporting (when element below) the foot 98, and a narrow flat surface 160*d* for limiting transverse travel of the leg 96. A U-shaped beam 162 providing a groove 162*a* for receiving the foot 94, an inner flat surface 162*b* for supporting (when element above) the foot 94 and an inner flat surface 162*c* for supporting (when element below) the foot 94, and a narrow flat surface 162*d* for limiting transverse travel of the leg 92.

The beam 160 is fixed to the bracket 100, by two bolts 164 and respective nuts, in nominal alignment with the beam 112 when the interface unit is in its rectangular, nondistorted disposition. The mutually adjacent ends of the beams 160 and 112 have respective curvilinear edges 160*e* and 112*e* which mutually define a curvilinear gap which permits the beam 112 to swing through the desired distortion, previously defined at ±8° and permits a contraction of one-half of the desired contraction, previously defined as −0.20 inches. The shape of the gap provides that the foot 98, as it passes from the beam 160 to the beam 112, is at all times supported by the respective surfaces of either or both beams and never falls into the gap, even when the gap is at maximum width as defined by the slot 130 and the bolt 132. The surfaces 160*a* and 112*a*, 160*b* and 112*b*, 160*c* and 112*c*, 160*d* and 112*d* are normally coplanar. When the beam 112 is twisted, the clearances are still adequate to permit free movement of the foot from one beam to the other (and vice-versa). The beam 162 is similarly aligned and has a curvilinear gap with the beam 110.

On the bracket 102 there are provided a symmetrical set of bosses 150', 152', 154' (not visible), 156', and 158', and beams 160' (not visible) and 162' (not visible), with respective surfaces and gaps as described for the bracket 100.

What is claimed is:

1. An interface structure for use between a recoiling gun and a stationary ammunition supply which are intercoupled by a train of sequential conveyor elements, each element having a body to receive a respective round of ammunition and two, mutually oppositely directed feet:

a first bracket adapted to be fixed to the gun;

a second bracket adapted to be fixed to the supply;

a first U-shaped beam having one end pivotally coupled to said first bracket and the other end pivotally coupled to said second bracket;

a second U-shaped beam having one end pivotally coupled to said first bracket and the other end pivotally coupled to said second bracket;

said first beam having a first longitudinally extending groove, defined by two mutually facing longitudinally extending surfaces, and adapted to receive therein and two guide one of the feet of each of the elements; and said second beam having a second longitudinally extending groove, defined by two mutually facing longitudinally extending surfaces, and adapted to receive therein and to guide the other of the feet of each of the elements, said first grove facing, and its two surfaces being coplanar, with said second groove and its two surfaces, respectively;

said first and second brackets and said first and second beams together manually defining a rectangle which is adapted to be distorted into a parallelogram by motion of the gun relative to the supply.

2. An interface structure according to claim 1, wherein:

a first additional U-shaped beam is fixed to said first bracket with one end thereof adjacent said one end of said first U-shaped beam, and has a first additional longitudinally extending groove, defined by two mutually facing, longitudinally extending surfaces which are respectively coplanar with said two surfaces of said first beam, and adapted to receive therein and to guide the one of the feet of each of the elements;

a second additional U-shaped beam is fixed to said first bracket with one end thereof adjacent said one end of said second U-shaped beam, and has a second additional longitudinally extending groove, defined by two mutually facing, longitudinally extending surfaces which are respectively coplanar with said two surfaces of said second beam, and adapted to receive therein and to guide the other of the feet of each of the elements;

said pivotally coupled one end of said first beam and said adjacent fixed one end of said first additional beam being respectively configured to define a first gap therebetween which permits said first beam to pivot with respect to said first additional beam yet permits the one of the feet of each of the elements to continually overlie one or both of said beams as it passes from one to the other of said beams; and said pivotally coupled one end of said second beam and said adjacent fixed one end of said second additional beam being respectively configured to define a second gap therebetween which permits said second beam to pivot with respect to said second additional beam yet permits the other of the feet of each of the elements to continually overlie one or both of said beams as it passes from one to the other of said beams.

3. An interface structure according to claim 2, wherein:

a first yet-additional U-shaped beam is fixed to said second bracket and is substantially identical to said first additional beam in form and function; and a second yet-additional U-shaped beam is fixed to said second bracket and is substantially identical to said second additional beam in form and function.

4. An interface structure according to claim 3, wherein:

a first plurality of guide beams, are pivotally coupled at each end respectively to and between said first and second brackets and each has a respective surface for guiding the cases of rounds of ammunition carried by the train of conveyor elements.

5. An interface structure according to claim 4, wherein:

a second plurality of bosses, equal to said first plurality, are fixed to said first bracket respectively adjacent the end of said first plurality of guide beams, and each boss has a respective surface adjacent to and coplanar with the respective said surface of said guide beam to permit each case to overlie one or both of said boss and beam surfaces as each case passes from said first bracket to said respective beam.

6. An interface structure according to claim 5, wherein:

a third plurality of bosses, equal to said first plurality are fixed to said second bracket respectively and are substantially identical to said second plurality of bosses in form and function.

* * * * *